US005078581A

United States Patent [19]

Blum et al.

[11] Patent Number: 5,078,581

[45] Date of Patent: Jan. 7, 1992

[54] CASCADE COMPRESSOR

[75] Inventors: Arnold Blum, Gechingen; Manfred Perske, Sindelfingen; Manfred Schmidt, Schönaich, all of Fed. Rep. of Germany

[73] Assignee: International Business Machines Corporation, Armonk, N.Y.

[21] Appl. No.: 562,302

[22] Filed: Aug. 3, 1990

[30] Foreign Application Priority Data

Aug. 7, 1989 [DE] Fed. Rep. of Germany ..... 3926066

[51] Int. Cl.[5] ..... F04B 17/00

[52] U.S. Cl. ..... 417/322

[58] Field of Search ..... 417/322, 413, 474

[56] References Cited

U.S. PATENT DOCUMENTS 4,895,500 1/1990 Hok et al. ..... 417/413 X
4,911,616 3/1990 Laumann, Jr. ..... 417/413
4,923,000 5/1990 Nelson ..... 417/322 X
4,938,742 7/1990 Smits ..... 417/322 X

*Primary Examiner*—Leonard E. Smith
*Attorney, Agent, or Firm*—Francis J. Thornton

[57] ABSTRACT

The compressor cascade comprises a plurality of tandem-connected membrane pumps, each of the pumps having a plurality of stroke chambers whose volumes decrease in the direction of the fluid flow through the pumps. Each chamber has several parallel-connected input/output channels for interconnecting the individual membrane pumps and a check valve in each input-/output channel for forcing the fluid in a specified direction. By electrostatic attraction forces, the membranes in the pumps are energized synchronously to resonance oscillations of the same frequency and deflection, building up the necessary operating pressure as the fluid is moved from the stroke chamber of one membrane pump into the smaller volume stroke chamber of the next succeeding membrane pump. The movement of the fluid through the membrane pumps of the compressor cascade leads to its compression, and the pressure at the end of the cascade is related to the reduction in volume of each succeeding stroke chamber.

3 Claims, 5 Drawing Sheets

CROSS SECTIONAL VIEW OF COMPRESSOR CASCADE ELEMENT ALONG PLANE S1

CROSS SECTIONAL VIEW OF COMPRESSOR CASCADE ELEMENT ALONG PLANE S1

CROSS-SECTION VIEW OF COMPRESSOR CASCADE ELEMENT ALONG PLANE S2

COMPRESSOR CASCADE ELEMENT
SECTIONAL VIEW OF A-PLATE

COMPRESSOR CASCADE ELEMENT
SECTIONAL VIEW OF MEMBRANE/
VALVE PLANE

COMPRESSOR CASCADE ELEMENT
SECTIONAL VIEW OF B-PLATE

ARRANGEMENT OF MEMBRANE PUMPS IN COMPRESSOR CASCADE

CASCADE COMPRESSOR

DESCRIPTION

The invention relates to a cascade compressor and a method of increasing the pressure of a fluid. The cascade compressor may be used to cool semiconductor devices and for pneumatic controls or be employed in actuators and sensors.

A survey of different cooling systems is contained in "*Cryocoolers*", Part 1: Fundamentals, by G. Walker, Plenum Press; an example of a highly compact conventional cooling system, the "Small Integral Stirling Cooling Engine", being shown in FIG. 1.2 of that citation. The essential elements of a cooling system are integrated in a component measuring only a few cubic centimeters.

A micromechanical cooling system is presented by W. A. Little in "Design and construction of microminiature cryogenic refrigerators", AIP Proceedings of Future Trends in Superconductive Electronics, Charlottesville, University of Virginia, 1987. In the "Joule-Thomson Minirefrigeration System", the different elements, such as heat exchanger, expansion nozzle, gas inlet/outlet regions and liquid collector, are produced micromechanically in one piece of silicon. The flow channels of the heat exchanger have a diameter of 100 μm at a total channel length of about 25 cm and must be capable of withstanding a gas pressure of about 70 bar. The temperature difference between gas inlet and expansion nozzle is limited by the high thermal conductivity of the silicon.

"*Sensors and Actuators*", 15 (1988) 153–167, by H. T. G. van Lintel et al, describes a micropump realized by micromachining a silicon wafer of about 5 cm diameter. The micropump has a glass-silicon-glass sandwich structure comprising 1 or 2 pump chambers and 2 to 3 valves. The operating pressure is built up by applying a voltage to the piezoelectric double-layer pump membrane.

The cascade effect is used by Keesom in his "Cascade Air Liquefier" (FIG. 2.7 in "Cryogenic Engineering" by Russel B. Scott, D. van Nostrand Company, Inc.) for air liquefication by four series-connected evaporator systems for liquids of progressively lower boiling points.

DE 32 02 324 A1 describes a heat pump comprising a condenser consisting of several parallel-connected identical compressors, the membrane centers of which are pressed together by mechanical forces during the operating cycle, compressing gas and transferring it to heat exchangers.

Compressors for cooling small components, such as semiconductor chips, must meet stringent requirements with regard to their geometric dimensions and compactness. The compressors are advantageously integrated in the chip substrate or the module. High operating pressures in micromechanical cooling systems reduce their reliability, rendering the control of the individual membrane pumps extremely elaborate.

The above-described problem is solved by the present invention which utilizes the higher pump efficiency obtained from the cascade effect combined with a lower power consumption obtained by tandem-connecting a plurality of membrane pumps such that their compression effect is controllable. Each pump comprises a pair of stroke chambers separated by a membrane, a valved input and a valved output. The arrangement and design of the cascaded membrane pumps are such that compression may be effected at a low operating pressure, that all membranes may be simultaneously energized to resonance oscillations and both stroke chambers of each membrane pump in the cascade are used for the actual compression process. The compressor cascade described in the invention may be integrated in electronic components, such as semiconductor chips and provided with other components, such as a heat exchanger and an expansion nozzle thus providing a very compact, miniature, cooling system. The micromechanical production process known to the silicon technology permits a considerable miniaturization of the compressor cascade, thus affording a high complexity combined with a high pump speed.

One way of carrying out the invention is described in detail below with reference to drawings which illustrate only one specific embodiment, in which:

FIGS. 1*a* and 1*b* each show a cross-sectional view of a compressor cascade element with three membrane pumps along planes S1 and S2 of FIG. 2.

FIG. 2*a* is a plan view of the A-plate of FIG. 1*a;*

FIG. 2*b* is a plan view of the membrane and the valve plane of FIG. 1*a;* and FIG. 2*c* is a plan view of the B-plate of FIG. 1*a;*

Compressor cascades contemplated by the invention may comprise hundreds of membrane pumps.

Figure 1A:
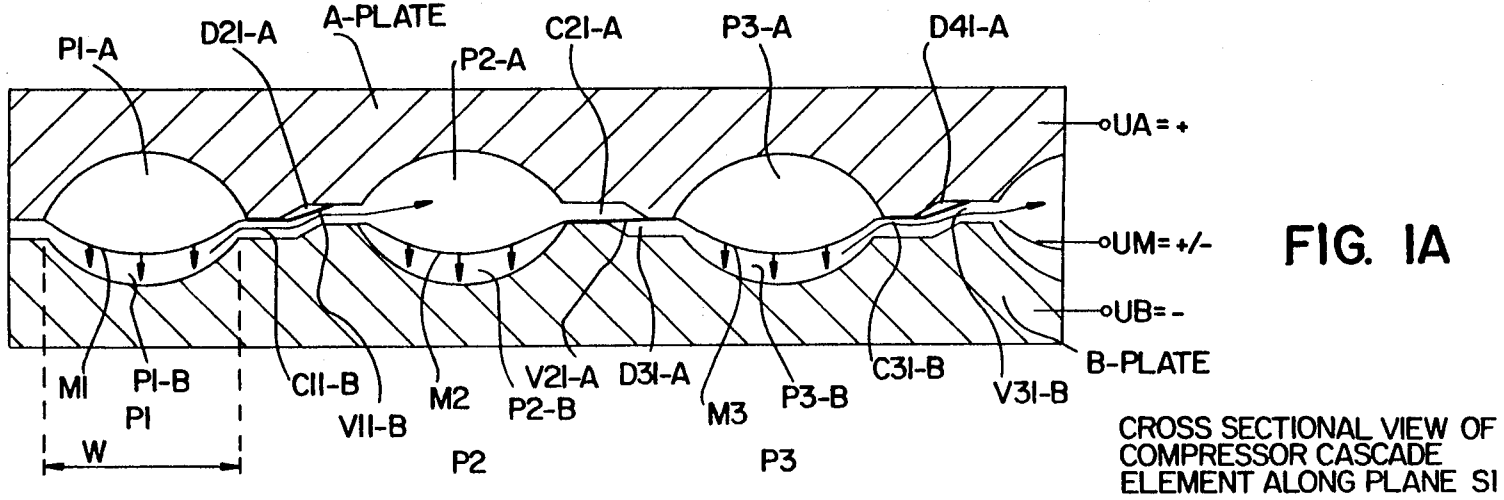
Figure 1B:
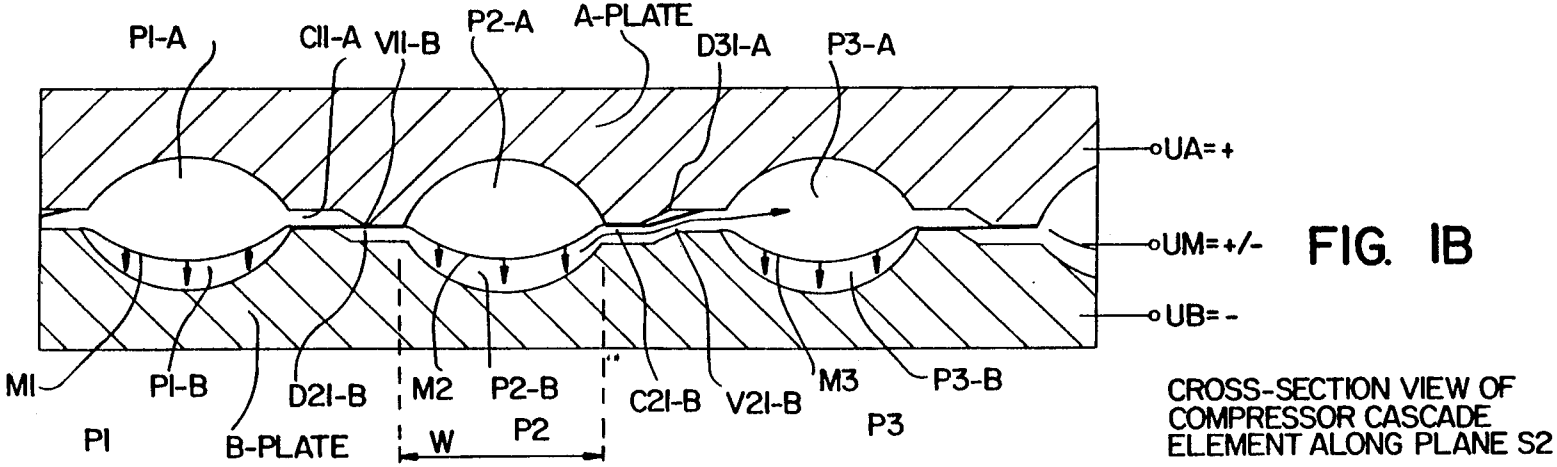

FIGS. 1*a* and 1*b* show only a portion of a compressor cascade. In these FIGS. 1*a* and 1*b* there is shown three tandem-connected membrane pumps P1, P2 and P3. Each membrane pump has two identically sized stroke chambers P1-A and P1-B, P2-A and P2-B, P3-A and P3-B, separated from each other by a respective potential carrying membrane M1, M2 and M3. The individual membrane pumps are connected by input/output channels D21-A, D31-A, D41-A, D21-B, D31-B, C11-A, C21-A, C11-B, C21-B and C31-B containing valves V11-B, V210-A, V31-B, V11-A, V21-B which are in the form of thin foils and act as check valves to prevent backwards flow of the fluid being pumped.

The material of plates A and B may be various conductive semiconductor materials, such as silicon, which are processable and treated so that different electrical potentials can be applied to each plate.

In such a case the stroke chambers are fabricated in the two opposed plates of silicon A and B by standard etch techniques used to produce integrated circuits, such as reactive ion etching, reactive ion beam etching, isotropic etching, etc. Suitable etch techniques are described by K. Petersen in "Techniques and Applications of Silicon Integrated Micromechanics" in RJ3047 (37942) 02/04/81.

The membranes and valves may be produced by using coating, lithography and etch methods well known to those skilled in the production of electronic circuits. Techniques such as evaporation, different methods of chemical vapor deposition (CVD), high-resolution optical or x-ray lithography methods, as well as isotropic and anisotropic etch techniques can all be used. Suitable foil materials for the membranes and valves can be metals, such as aluminum or copper, metallically coated synthetic foils or metallically coated silicon dioxide films. A process cycle for producing the membranes is described, for example, by K. E. Petersen in "*IBM Technical Disclosure Bulletin*", Vol 21, No. 9, February 1979, pp. 3768-3769. These membranes must be capable of carrying a potential different from the potential applied to either plate.

The valves are preferably shaped as cantilever beams which can be operated by the mechanical pressure of the fluid or medium being pumped, or as electrostatically controlled switches, as described by K. E. Petersen in "IEEE Transactions On Electronic Devices" 25 (1978) 215.

Figure 2A:
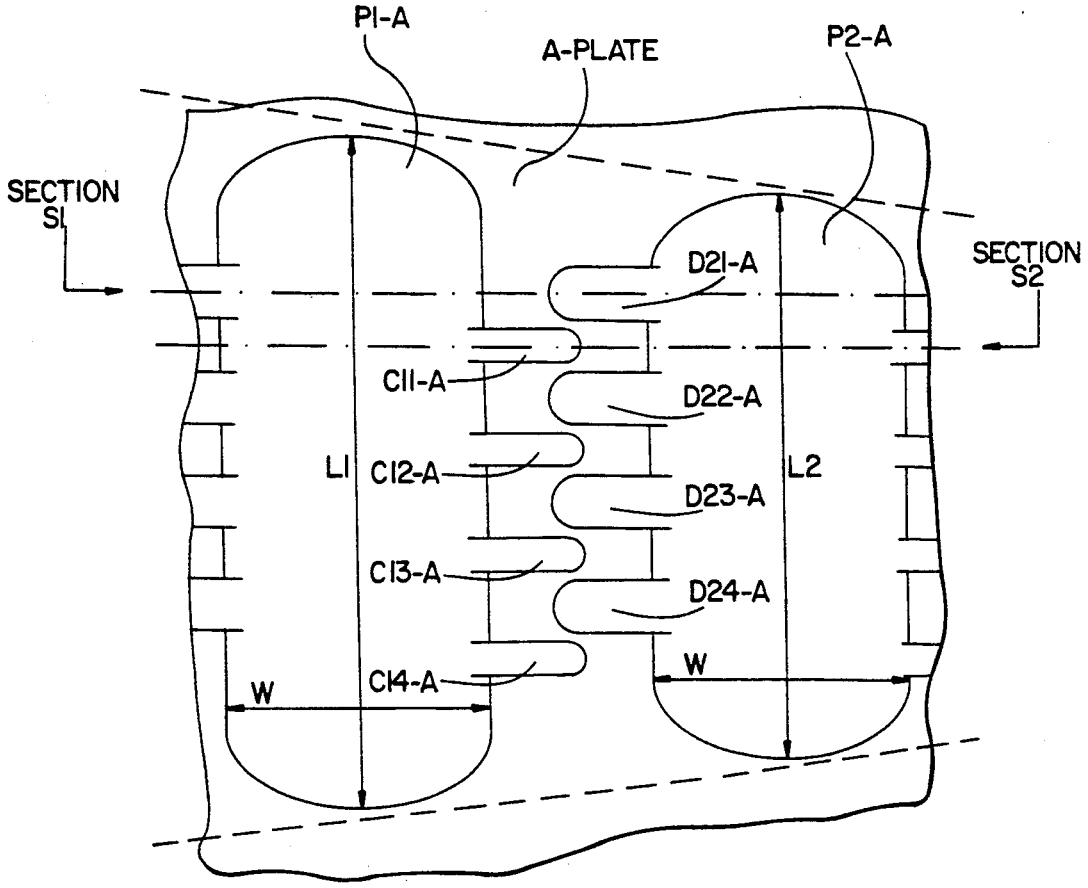
Figure 2B:
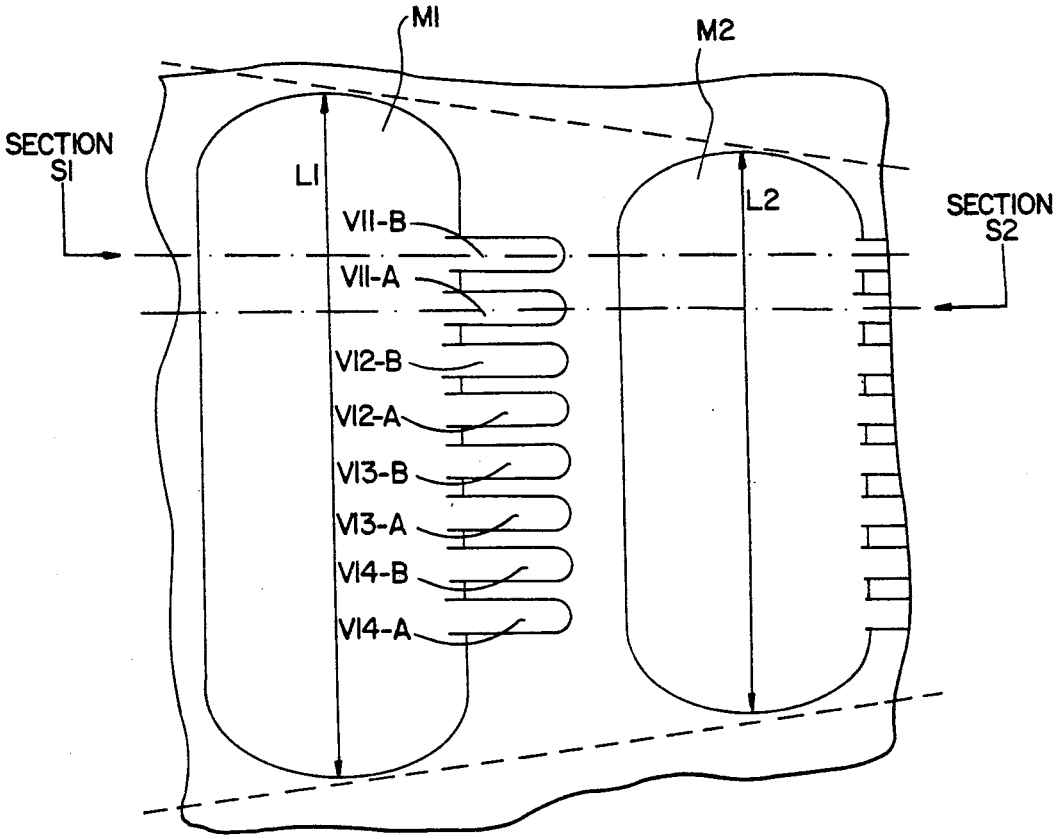
Figure 2C:
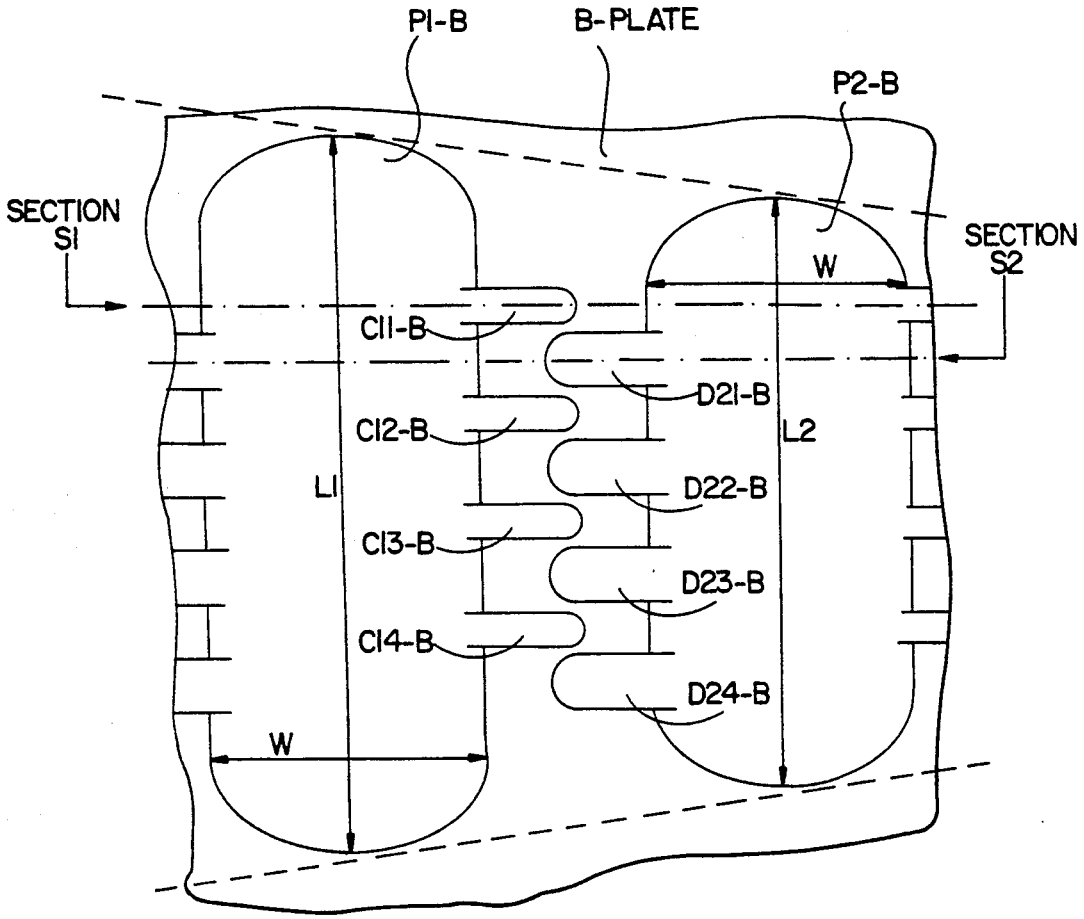

FIG. 2*a* is a plan view of the stroke chambers P1-A and P2-A in the area of the A-plate and FIG. 2*c* of the stroke chambers P1-B and P2-B in the area of the B-plate of the membrane pumps P1 and P2. By creating all the stroke chambers with the same width and light but with different lengths, L1 and L2, compression of the fluid is achieved since the volume of each succeeding chamber decreases in the direction of the fluid flow through the cascade. The long sides of the stroke chambers are fitted with input/output channels D21-A to D24-A, D21-B to D24-B and C11-A to C14-A, C11-B to C14-B. By using elongated chambers, a plurality of input/output channels may be arranged in the long sides. This increases the channel cross-section, leading to a high throughput of the fluid being pumped.

In one embodiment, the width W of the stroke chambers was 20 μm, the length 3 μm and the length L1 of the longest membrane pump P1 100 μm. The length of succeeding pumps were succeedingly smaller.

Because the plates and membranes are all electrically isolated from each other fixed negative and positive voltages are respectively applied to plates A and B and an oscillating potential varying from positive to negative is applied to membranes M1 . . . Mn. The voltages applied to the plates and the membranes causes, by electrostatic attraction forces, the membranes to oscillate between A or B as the voltage applied to the membranes oscillates. The membranes Mn behave oscillate substantially synchronously in the same direction of deflection at the resonance frequency defined by the width W. By decreasing the width W, high resonance frequencies may be obtained. The useful operating pressure Δp for the compression process is identical for all the membrane pumps and relates to the electrostatic attraction force acting on membranes Mn and thus the pump medium.

As shown in FIGS. 1*a* and 1*b*, the potential UM+ is applied to the membrane such that with membranes M1, M2, M3 being deflected in the direction of the B-plate which is negatively biased by voltage UB−. The membrane deflections cause the medium in the stroke chambers of the B-plate P1-B, P2-B, P3-B of the membrane pumps P1, P2, P3 to be pumped into next adjacent the stroke chamber of the A-plate P2-A, P3-A, P4-A. This pumping flow occurs because the flow pressure opens the valves V11-B, V21-B, V31-B arranged between the outlet channels C11-B, C21-B, C31-B and the inlet channels D21-A, D31-A, D41-A. Because the pressure of the pumped medium is equal in all directions the valves V11-A, V21-A, V31-A are forced upwards against the A-plate and thus remain closed, preventing a back flow of the fluid. This action proceeds substantially synchronously in all the membrane pumps of the compressor cascade.

When the voltage on the membranes is changed from positive to negative the membranes are pulled towards the A-plate causing the pump fluid or medium in the stroke chambers of the A-plate of pumps P1, P2, P3 to be moved to the stroke chambers of the B-plate of the respective next pumps P2, P3, P4. In this instance the valves V11-A, V21-A, V31-A are opened and valves V11-B, V21-B, V31-B closed. This also proceeds synchronously in all the membrane pumps.

Figure 3:
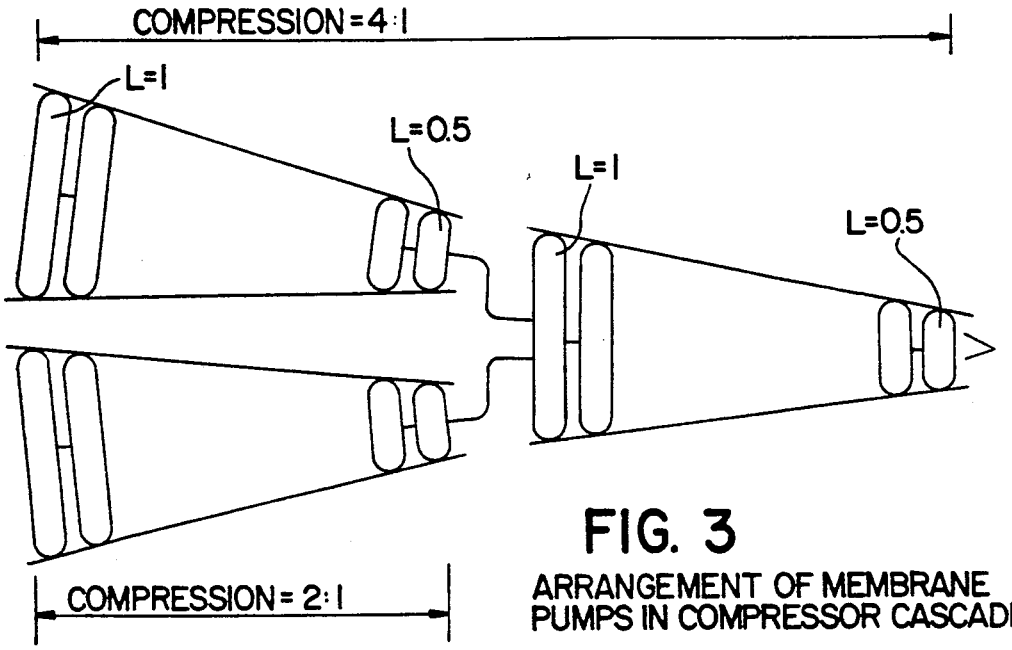
FIG. 3 is a schematic of the tandem-connected membrane pumps in the compressor cascade.

During its movement through the membrane pumps of the compressor cascade, the fluid (gas or liquid) being pumped, is compressed as the volume of the stroke chambers decrease. Therefore, the pressure in any stroke chamber is directly related to the volume of the chamber. Thus, by making each succeeding chamber smaller than the previous one the pressure of the third being pumped is increased as it progresses along the cascade. One possible arrangement, of volume reduction of the stroke chambers, is shown in FIG. 3. In this arrangement, the compression ratio for the cascade totals 4:1, and is obtained by arranging two compression stages in parallel and feeding their outputs to a single compression stage. Each stage has a compression ratio of 2:1.

The pressure increase between two adjacent membrane pumps Pn and PN+1 corresponds to the difference in volume of the two adjacent pumps. The volume reduction may take place in arbitrarily small steps, so that each individual pump operates at an extremely low operating pressure but a number of pumps Pn yields a high pressure differential at the end of the compressor cascade. Thus, the thin membranes Mn and the valves Vnm-A, Vnm-B are only subjected to the low operating pressure p of 0.001 BAR compared with the relatively high gas pressure of about 70 BAR in the above-mentioned Joule-Thomson system by W. A. Little.

Figure 4A:
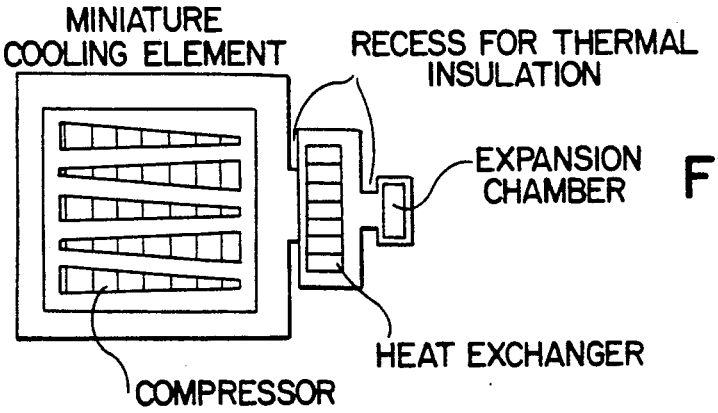
FIG. 4 is a miniature cooling element with the compressor cascade according to the invention and further components required for the cooling elements, FIG. 4*a* being a plan view, and FIG. 4*b* being a cross-sectional view.
Figure 4B:
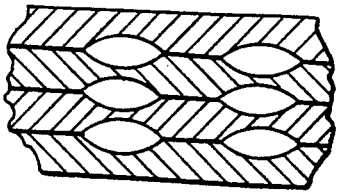

FIGS. 4*a* and 4*b* show one of a number of conceivable applications for the compressor cascade described in the invention.

FIG. 4*a* is a plan view of a miniature cooling element which, in addition to the compressor cascade, comprises further components, such as heat exchanger and expansion chamber. The compressor area and the heat exchanger as well as the heat exchanger and the expansion chamber are thermally insulated from each other by recesses preventing heat transfer between those elements. FIG. 4*b* shows the compact design of the compressor. In FIG. 4*b* four silicon wafers are positioned on top of each other, three compressor planes are arranged. This allows a considerable increase in the power density of the compressor.

Having now described the invention, it should be obvious to those skilled in the art that the claims of the present invention should not be limited to the described embodiment but should be limited only by the appended claims wherein.

We claim:

1. A compressor comprising a plurality of cascaded membrane pumps:

each pump comprising, a first layer of material capable of sustaining a first fixed potential, having a cavity of predetermined length, width, and height, a second layer of material capable of sustaining a second fixed potential having a cavity of said length, width, and height therein complementing the cavity in said first layer, membrane means capable of sustaining a third fixed potential positioned in between the cavities in said first and second layers, each recess having input means and output means, check valve means positioned in the input means and in the output means of each cavity, means for introducing a fluid in said compressor, and means for applying said first, second and third potential to said first layer, said second layer and said membrane respectively to pump said fluid through said compressor.

2. The compressor of claim 1 wherein:

each pump in said cascade has a distinctive length, the length of each pump being longer than the length of each succeeding pump in said cascade to compress the fluid introduced into said compressor.

3. The compressor of claim 1 wherein the volume of each membrane pump in the cascade is less than the volume of each preceding pump.

* * * * *